US005669050A

United States Patent [19]

Sakemi et al.

[11] Patent Number: 5,669,050

[45] Date of Patent: Sep. 16, 1997

[54] DEVELOPING APPARATUS USING BLANK PULSE BIAS

[75] Inventors: Yuji Sakemi, Inagi; Koji Amemiya; Takeshi Menjo, both of Tokyo; Masahiro Inoue; Masami Izumizaki, both of Yokohama, all of Japan

[73] Assignee: Canon Kabushiki Kaisha, Tokyo, Japan

[21] Appl. No.: 365,034

[22] Filed: Dec. 28, 1994

[30] Foreign Application Priority Data

Dec. 29, 1993 [JP] Japan ..... 5-352168
Mar. 25, 1994 [JP] Japan ..... 6-055727

[51] Int. Cl.[6] ..... G03G 21/00

[52] U.S. Cl. ..... 399/270; 399/267

[58] Field of Search ..... 355/251, 265, 355/246; 118/651, 657, 658; 430/103, 107, 110, 122

[56] References Cited

U.S. PATENT DOCUMENTS

| | | | |
|---|---|---|---|
| 4,473,627 | 9/1984 | Kanbe et al. | 430/102 |
| 4,557,992 | 12/1985 | Haneda et al. | 430/122 |
| 4,610,531 | 9/1986 | Hayashi et al. | 355/14 |
| 4,777,107 | 10/1988 | Kurematsu et al. | 130/122 |
| 4,841,332 | 6/1989 | Haneda et al. | 355/251 |
| 4,844,008 | 7/1989 | Sakemi et al. | 118/658 |
| 4,883,019 | 11/1989 | Menjo et al. | 118/691 |
| 5,177,536 | 1/1993 | Watanabe et al. | 355/251 |
| 5,187,523 | 2/1993 | Osawa | 355/251 |
| 5,239,343 | 8/1993 | Sakemi et al. | 355/253 |
| 5,267,007 | 11/1993 | Watanabe et al. | 355/245 |
| 5,287,148 | 2/1994 | Sakemi et al. | 355/245 |
| 5,294,967 | 3/1994 | Munakata et al. | 355/326 R |
| 5,424,812 | 6/1995 | Kemmochi et al. | 355/251 |

FOREIGN PATENT DOCUMENTS

| | | |
|---|---|---|
| 55-32060 | 3/1980 | Japan . |
| 56-14268 | 2/1981 | Japan . |
| 56-144452 | 11/1981 | Japan . |
| 58-68051 | 4/1983 | Japan . |
| 59-165082 | 9/1984 | Japan . |
| 59-181362 | 10/1984 | Japan . |
| 60-176069 | 9/1985 | Japan . |

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

An image forming apparatus includes an image bearing member for bearing an electrostatic image; a developer carrying member, opposed to the image bearing member, for carrying a developer containing toner; bias voltage applying device for applying a developing bias voltage to the developer carrying member, the bias voltage satisfying:

$$T1 < 8.94d/\sqrt{|V2 - V1|},$$

$$T3 > (133d^2/T2|V2 - V1|) - 1/2T2$$

V1 (V): a voltage applying force to the toner toward the developer carrying member away from the image bearing member;

T1 (sec): a time period of application of the voltage V1;

V2 (V): a voltage applying force to the toner away from the developer carrying member toward the image bearing member;

T2 (sec): a time period of application of the voltage V2;

T3 (V): a time period of application of a voltage V3 which is (V1+V2)/2;

d (m): distance between the image bearing member and the developer carrying member.

9 Claims, 4 Drawing Sheets

DEVELOPING APPARATUS USING BLANK PULSE BIAS

FIELD OF THE INVENTION AND RELATED ART

The present invention relates to an image forming apparatus such as a copying machine, printer, recording image display apparatus, facsimile machine or the like in which an electrostatic latent image is developed into a visualized image, the electrostatic latent image having been formed on an image bearing member through an electrophotographic process, an electrostatic recording system or the like.

In such an image forming apparatus, it is known that a dry developer comprising toner particles and magnetic carrier particles as a visualizing material is supplied to the surface of a developer carrying member, and is fed to the neighborhood of the surface of the image hearing member forming a magnetic brush of developer on the developer carrying member. An alternating electric field is formed between an image bearing member and a developer carrying member to visualize the electrostatic latent image. This developing method is usually a magnetic brush developing method.

The developer carrying member is usually in the form of a developing sleeve, and therefore, is called here "developing sleeve". The image bearing member is usually in the form of a photosensitive drum, and therefore, it is called here "photosensitive drum".

In the developing method, two component developer (carrier particles and toner particles) are known. The developer is carried on the developing sleeve and formed into a magnetic brush which is contacted or brought close to the photosensitive drum which is disposed with a small clearance from the surface of the developing sleeve. By the application of an alternating electric field continuously between the developing sleeve and the photosensitive drum, the toner particles are transferred from the developing sleeve to the photosensitive drum and then are transferred back from the photosensitive drum to the developing sleeve, repeatedly, as disclosed in Japanese Laid-Open Patent Applications Nos. 32060/1980, 165082/1984, or the like. A non-contact type alternating electric field method using two component developer is known for a simple color development or superimposed image development, as disclosed in Japanese Laid-Open Patent Applications Nos. 14268/1981, 68051/1983, 144452/1981, 181362/1984, and 1760690/1985. Among the image forming apparatuses using such a developing process, there is a laser beam printer of an electrophotographic type as a high speed and low noise printer. The typical use of such a printer is bilevel recording for characters and figures. A laser beam is rendered on or off corresponding to the image signal to be recorded, while scanning the electrophotographic photosensitive member. Since the character and figure recording does not require halftone level, the structure of the printer is relatively simple. In order to produce halftone level in the bilevel type laser beam printer, a dithering method, or a density pattern method are known.

However, the dithering or density pattern method are not good in image resolution. Recently, therefore, a method of producing halftone images without reducing the recording method and therefore maintaining the high resolution, has been proposed. In this method, the width of the pulse signal for driving the laser is modulated so as to produce the tone image. More particularly, the light emitting period per one pixel of the laser is controlled in accordance with a desired density of the image, so that the exposure period of the photosensitive member per one pixel by the laser beam scanning the photosensitive member is controlled in accordance with the image density.

More specifically, the pulse width of the pulse signal is short for the low density portion to reduce the exposure period, and the pulse width is long for the high density portion to increase the exposure period of the photosensitive member. This is called a pulse width modulation system (PWM). In this, an image of high resolution and high tone reproduction can be produced. Therefore, the PWM system is particularly advantageous for a color image forming apparatus which particularly requires both high resolution and high toner level reproduction.

However, when an image is produced by a conventional copying machine, the image has been found rough in a halftone area of leas than 0.3 in refraction density. The roughness does not occur much in character reproduction or the like, but occurs more frequently in the low density portion in a photographic image or the like.

Investigations have been made to find the causes of this phenomenon, and the following has been found. Usually, when a high light latent image is formed by dots, the latent image on the photosensitive member is microscopically not a broad latent image as in an analog latent image, but is a local latent image. When a further lower image density is to be reproduced, the latent image becomes dull because of the influence of the film thickness of the photosensitive member, with the result that the maximum contrast V0 gradually decreases as shown in FIG. 3. For example, when an image having a reflection density of approximately 0.2 is reproduced, the contrast is approximately 150–250 V. In the case of reverse development, the surface potential of the non-image portion is set to be 100–200 V higher than the DC component of the developing bias in order to avoid fog. Therefore, the potential difference Vcont from the DC component of the developing bias in the case of V0 of 150–250 V, is approximately 0–100 V. A Vcont of 0–100 V means significant instability in that it is at the boundary between whether the toner is to be deposited on the photosensitive member or on the sleeve. For this reason, when the latent image is developed by the two component developer, the state of contact of the magnetic brush is significantly influential to the development efficiency, so that a dot may be missing due to the non-uniformity of the magnetic brush, and therefore, image roughness may occur.

In order to avoid the roughness, it has been proposed that an alternating electric field is superimposed on the developing bias, and the frequency of the bias voltage is increased to not less than 6 kHz to prevent toner reciprocation through one pulse. By this method, the toner particles vibrates in a manner that they do not completely reciprocate across the gap between the sleeve and the photosensitive drum. When the potential difference Vcont between the surface potential of the photosensitive drum and the DC component of the developing bias voltage is smaller than 0, the DC component functions to attract the toner to the sleeve, so that the toner is offset toward the sleeve. When Vcont >0, the DC component functions to attract the toner to the drum in accordance with the potential voltage, so that the amount of the toner corresponding to the latent image potential is offset toward the photosensitive drum. This tendency is further pronounced by intermittently applying the alternating electric field. Under these conditions, the toner arriving at the photosensitive drum repeats the vibration on the photosensitive drum so that it is concentrated at the latent image portion. Therefore, the dot shape is made more uniform so that an image without non-uniformity can be provided.

However, this developing method has a drawback in that it is usable only for a toner having a triboelectric charge within a limited range. In the case of a toner having a high triboelectric charge, the toner is not easily removed from the carrier or the developing sleeve, and conversely, the toner having a low triboelectric charge is retracted back before it reaches the latent image, and as a result, the density significantly changes depending on the T/(T+C) ratio.

The amount of the toner supplied to developing zone by the rotation of the developing sleeve is two to three times that of the toner used for the development. Therefore, if almost all of the toner in the developing zone is reciprocated by the developing bias between the photosensitive drum and the developing sleeve so as to be involved in the developing operation, then the developing condition is determined on the basis of the state of the latent image, and therefore, the density variation depending on the T/(T+C) ratio is reduced.

However, in the conventional developing method, the dependency on that ratio is significant with the result of significant density change. This is because only the toner having a proper degree of triboelectric charge is involved in the developing action, and therefore, the amount of the toner involved in the development is changed depending on the variation of that ratio. Therefore, the change of the ratio is influential to the density of the developed image. Accordingly, in the above-described improved developing method, the roughness of the image of 0.2–0.3 reflection density decreases, but the density variation due to the T/(T+C) ratio is particularly large in the low density side.

SUMMARY OF THE INVENTION

Accordingly, it is a principal object of the present invention to provide a developing apparatus and an image forming apparatus capable of providing a uniform high light portion of the image.

It is another object of the present invention to provide a developing apparatus and an image forming apparatus in which the density variation due to the variation of the toner/carrier ratio is suppressed.

According to an aspect of the present invention, there is provided an image forming apparatus comprising: an image bearing member for bearing an electrostatic image; a developer carrying member, opposed to the image bearing member, for carrying a developer containing toner; bias voltage applying means for applying a developing bias voltage to the developer carrying member, the bias voltage satisfying:

$$T1 < 8.94d/\sqrt{|V2 - V1|},$$

$$T3 > (133d^2/T2|V2 - V1|) - 1/2T2$$

V1 (V): a voltage applying force to the toner toward the developer carrying member away from the image bearing member;

T1 (sec): a time period of application of the voltage V1;

V2 (V): a voltage applying force to the toner away from the developer carrying member toward the image bearing member;

T2 (sec): a time period of application of the voltage V2;

T3 (V): a time period of application of a voltage V3 which is (V1+V2)/2;

d (m): distance between the image bearing member and the developer carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 7:
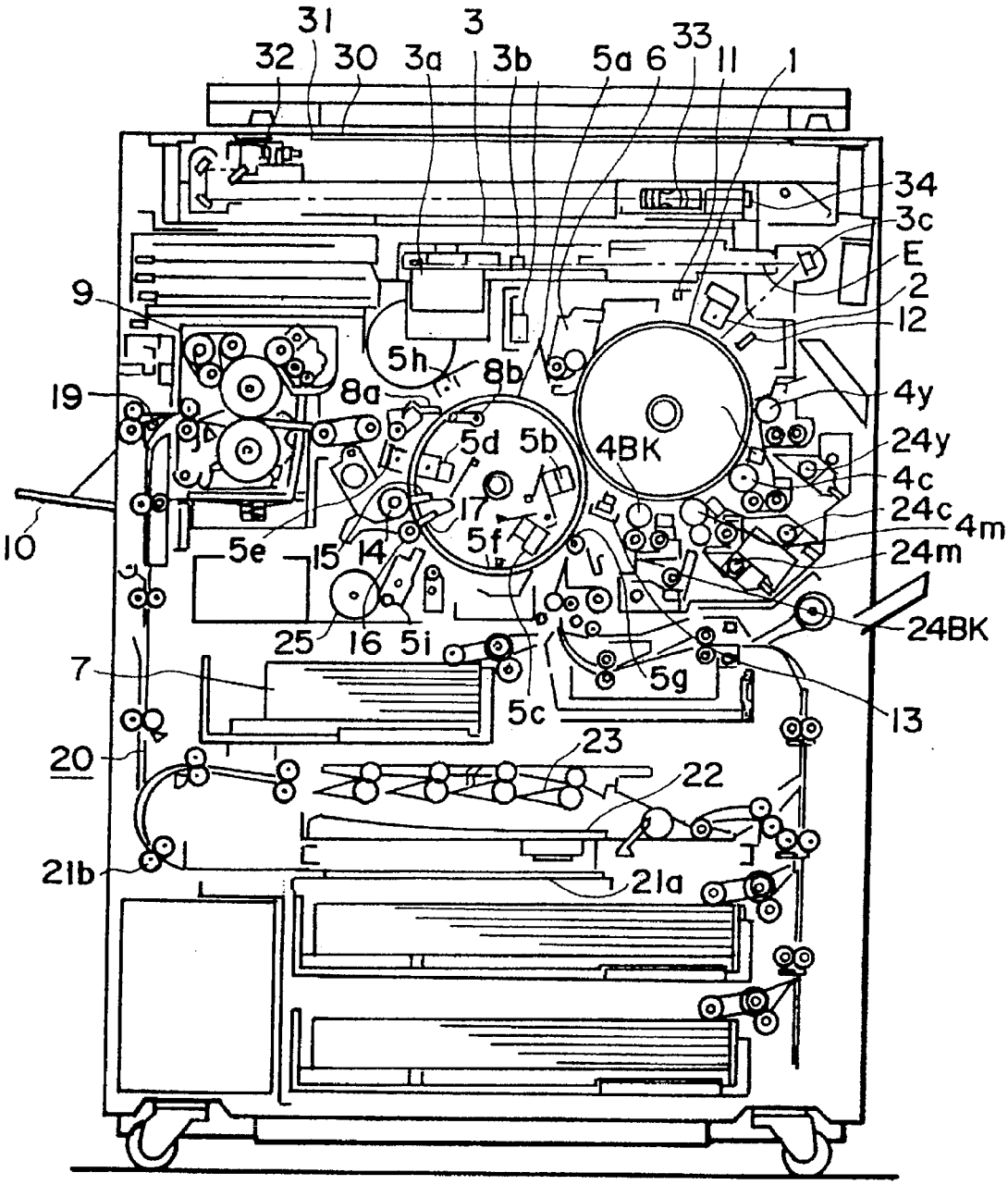
FIG. 7 is a sectional view of an image forming apparatus according to an embodiment of the present invention.

Referring first to FIG. 7, there is shown a color image forming apparatus according to an embodiment of the present invention.

The image forming apparatus comprises a digital color image reader at the top, and a digital color image printer at the bottom.

In the reader, an original 30 is placed on an original supporting platen glass 31, and is scanned by an exposure lamp 32. The light reflected by the original 30 is focused by a lens 33 on a full-color sensor 34, by which color separation image signals are produced. The color separation image signals are supplied to an unshown video processing unit through an amplifying circuit not shown, and are then supplied to the printer.

In the printer, there is provided a photosensitive drum 1 supported for rotation in the direction indicated by an arrow, and around the photosensitive drum 1 (image bearing member), there are provided a pre-exposure lamp 11, a corona charger 2, light beam emitting means in the form of a laser exposure optical system 3, potential sensor 12, four developing devices 4*y*, 4*c*, 4*m*, 4*bk* for different colors, detecting means 13 for detecting light quantity on the photosensitive drum, a transfer device 5 and a cleaning device 6.

The image signal from the reader is converted to a light signal by a laser (not shown), and the laser beam is reflected by a polygonal mirror 3*a* in the laser exposure optical system 3, and the beam is projected onto the surface of the photosensitive drum 1 through a lens 3*b* and a mirror 3*c*.

The laser is on-off-modulated by an electric signal which is PWM-modulated in accordance with the image density information.

When the printer forms the image, the photosensitive drum 1 is rotated in the direction indicated by an arrow, and it is electrically discharged by the pro-exposure lamp. Thereafter, the surface of the photosensitive drum is uniformly charged by a primary charger 2, and the light image E is projected thereon to form a latent image, for each color separated image.

Subsequently, a predetermined developing device is operated to reverse-develop the latent image on the photosensitive drum 1 so that a toner image is formed with the toner particles comprising resin as a major component. The developing devices are selectively brought close to the photosensitive drum 1 corresponding to the separated colors by the operation of eccentric cams 24*y*, 24*c*, 24*m* and 24*bk*.

Subsequently, the toner image on the photosensitive drum 1 is transferred onto a recording material supplied to a position opposed to the photosensitive drum 1, by a feeding system from a recording material cassette 7. A transfer device 5 comprises, in this example, a photosensitive drum 5*a*, a transfer charger 5*b*, an attraction roller 5*g* opposed to a attraction charger 5*c* for electrostatic attraction of the recording material, an inside charge 5*d* and an outside charger 5*e*. A recording material carrying sheet 5*f* made of a dielectric material is stretched into a cylinder in a peripheral opening portion of the transfer drum 5*a* supported for rotation. The recording material carrying sheet 5*f* is made of dielectric material such as polycarbonate film or the like.

By the rotation of the transfer drum 5*a*, the toner image is transferred from the photosensitive drum onto the recording material carried on the recording material carrying sheet 5*f*, by the operation of the transfer charger 5*b*.

Thus, onto the recording material attracted and carried on the recording material carrying sheet 5*f*, a desired number of color images are transferred to form a full-color image.

In the case of full-color image formation, after the transfer of the four color toner images, the recording material is separated by operations of separation claws 8*a*, separation urging roller 8*b* and separation charger 5*h*. The recording material is discharged onto a tray 10 through a heat roller fixing device 9.

After the image transfer, the surface of the photosensitive drum 1 is cleaned by a cleaning device 6 so that the residual toner on the surface thereof is removed, and is prepared for the next image forming operation.

When the images are to be formed on both sides of the recording malarial, a switching guide 19 is operated immediately after the discharge of the recording material from the fixing device, and it is introduced to a reversing path 21*a* through a longitudinal path 20, and thereafter, by the reverse rotation of the reversing roller 21*b*, it is reversely fed and is accommodated in an intermediate tray 22. Thereafter image is formed on the opposite side through the above-described image forming process.

In order to prevent scattering and deposition of powder materials on the recording material carrying sheet 5*f* of the transfer drum 5*a* and oil deposition on the recording material, the carrying sheet 5*f* is cleaned by cooperation of a fur brush 14, a backup brush 15 located across the sheet 5*f* from the fur brush 14, an oil removing roller 16, and a backup brush 17 disposed across the sheet 5*f* from the roller 16. The cleaning operation may be carried out prior to the start of the image forming operation or after the image forming operation or occurrence of sheet jam, if desired.

In this embodiment, an eccentric cam 25 is operated at a desired timing to operate a cam follower 5*i* integral with the transfer drum 5*f*, by which the gap between the recording material carrying sheet 5*a* and the photosensitive drum 1 can be properly changed. For example, during stand-by period or during power-off period, the gap between the transfer drum and the photosensitive drum is increased.

Figure 1:
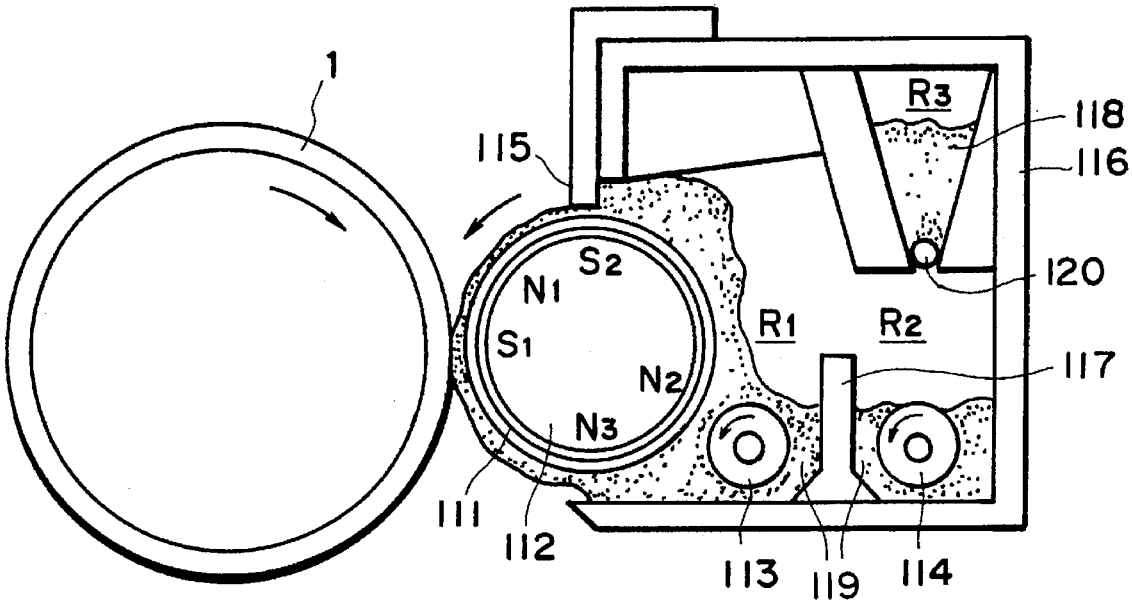
FIG. 1 is an enlarged sectional view of a developing apparatus according to an embodiment of the present invention.

Referring now to FIG. 1, there is shown a developing apparatus in an enlarged scale.

The developing apparatus comprises a developer container 116. The inside of the developer container 116 is divided into a developer chamber (first chamber) R1 and a stirring chamber (second chamber) R2 by a partition wall 117. A toner storing chamber R3 contains a toner (non-magnetic toner) 118 to be replenished. The partition wall 117 is provided with a supply port 120, and an amount of toner to be replenished 118 is allowed to fall into the stirring chamber R2, corresponding to the consumption through the supply port 120.

In the developer chamber R1 and the stirring chamber R2, the developer 119 is contained. The developer 119 is a two component developer comprising non-magnetic toner particles and magnetic carries particles (the mixture ratio is approx. 4–10% of the non-magnetic toner particles, by weight). The non-magnetic toner particles have a volume average particle size of $5–8\times10^{-6}$ m. The magnetic particles are ferrite particles (maximum magnetization of 50 emu/g) coated with resin material, and the weight average particle size is $5.0\times10^{-5}$ m. The resistance thereof is $10^{8}$ ohm.cm or larger. The magnetic permeability of the magnetic particles is approx. 5.0.

An opening is formed in the portion of the developer container 116 adjacent to the photosensitive drum 1, and the developing sleeve 111 is extended out through the opening. The developing sleeve 111 is mounted for rotation in the developer container 116. The outer dimension of the developing sleeve 111 is 32 mm, and the peripheral speed is $2.8\times10^{-1}$ m/sec. The developing sleeve 111 is disposed with a gap of $5.0\times10^{-4}$ m from the photosensitive drum 1. The developing sleeve 111 is made of non-magnetic material, and a stationary magnet 112 is fixed therein as a magnetic field generating means.

The magnet 112 comprises a developing magnetic pole S1 and a magnetic pole N3 downstream thereof, and developer carrying magnetic poles N2, S2 and N1. The magnet 112 is disposed in the developing sleeve 111 such that the developing pole S1 is faced to photosensitive drum 1.

The developing pole S1 forms a magnetic field in the neighborhood of the developing zone between the developing sleeve 111 and the photosensitive drum 1, and by the magnetic field, a magnetic brush is formed.

Above the developing sleeve 111, there is a blade 115 with a predetermined gap from the developing sleeve 111. The gap between the developing sleeve 111 and the blade 115 is $8.0\times10^{-4}$ m in this embodiment. The blade 115 is fixed on the developer container 116. The blade 115 is made of a non-magnetic material such as aluminum or SUS 316 to regulate a layer thickness of the developer 119 on the developing sleeve 111. In the developer chamber R1, a feeding screw 113 is accommodated. The feeding screw 113 is rotated in a direction indicated by an arrow. By the rotation of the feeding screw 113, the developer 119 in the developer chamber R1 is fed along the length of the developing sleeve 111.

In the storing chamber R1, a feeding screw 114 is accommodated. The feeding screw 114 feeds the toner along the length of the developing sleeve 111 and the toner falls by gravity into the stirring chamber R2 through the supply port 120.

The developing sleeve 111 carries the developer to a position adjacent the magnetic pole N2, and with the rotation of the developing sleeve 111, the developer 119 is conveyed to a developing zone. When the developer 119 reaches the neighborhood of the developing zone, the magnetic particles in the developer 119 erect from the developing sleeve 111 while being connected with each other, by the magnetic force of the pole S1, so that a magnetic brush of the developer 119 is formed.

The free edges of the magnetic brush rub the surface of the photosensitive drum 1 to effect the developing action. At this time, the volume ratio of the developer occupying the developing zone space (the volume ratio will be defined hereinafter), is within the range described below, and the bias voltage is applied between the developing sleeve 111 and the photosensitive drum 1, as shown in FIG. 4, by which an image with smooth high light portion and relatively immune to T/(T+C) ratio, is provided.

Figure 3:
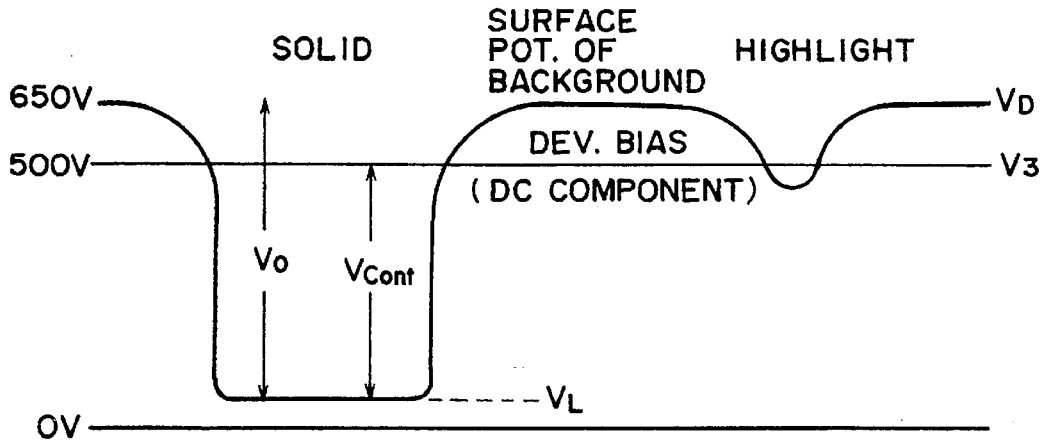
FIG. 3 shows a surface potential of a latent image at a solid image portion and a high light image portion.
Figure 4:
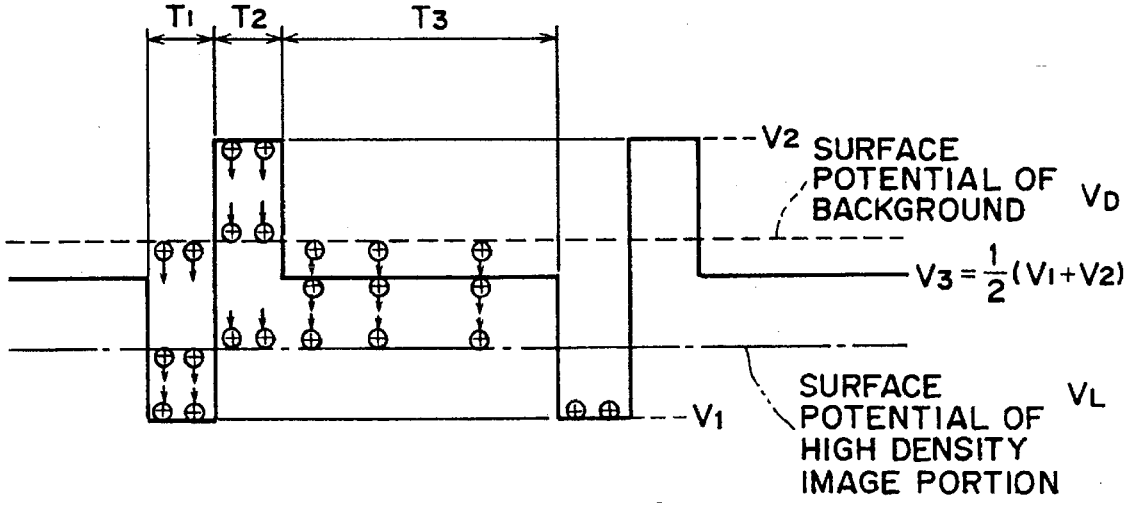
FIG. 4 is a wave form of a developing bias voltage according to an embodiment of the present invention.

Referring to FIG. 4, the bias voltage used in this embodiment will be described. When a back-transfer voltage V1 is applied for the time period T1, the toner particles on the image portion and non-image portion on the uniformly photosensitive drum are urged toward the sleeve. When a developing voltage V2 is applied for the time period T2, the toner particles in the developing zone are urged toward the image portion and the non-image portion. When a voltage V3 (=½(V1+V2) (blank voltage)) corresponding to a DC bias in consideration of the fog prevention in the non-image area (background area) is applied for the time period T3, the toner particles in the non-image portion are urged toward the sleeve, and the toner particles in the image portion (including the high light portion in FIG. 3) are urged toward the drum.

When these steps are repeated several tens of times during a developing operation, the toner particles are vibrated offset adjacent the image portion, as described hereinbefore, and therefore, the image in the high light portion which is not easily uniformly developed through a conventional step, can be sufficiently and uniformly developed into a smooth image.

In order to provide a uniform image relatively immune to T/(T+C), a relationship among the potential difference of the developing bias, S-D gap d (m), and the voltage application period T1, T2 and T3, are considered.

Figure 2A:
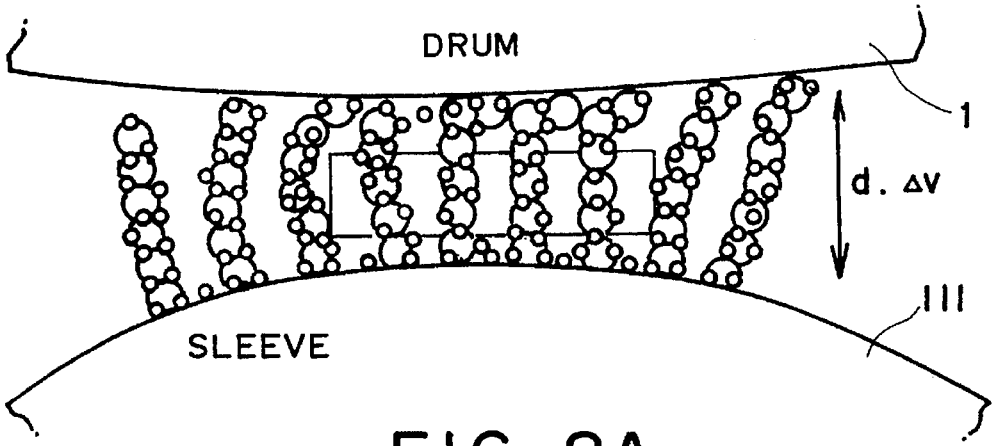
FIGS. 2A and 2B illustrate the force on a developer (toner).
Figure 2B:
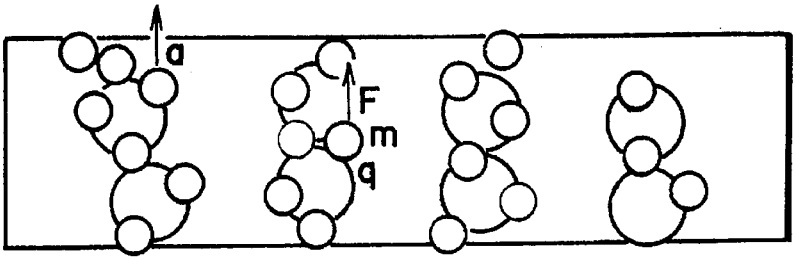

The relationship will be described together with movement of the toner. FIG. 2A shows the behavior of the developer in the developing zone. FIG. 2B illustrates an enlarged region of FIG. 2A. In the Figures, q is an amount of electric charge, m is a mass, a is an acceleration, δV is a potential difference between the photosensitive drum and the sleeve, and d is the gap between the photosensitive drum and the developing sleeve. The toner repeats the offset vibration adjacent the photosensitive drum by selecting a condition where the toner on the photosensitive drum is not returned onto the developing sleeve for the time period T1 in which the back-transfer voltage V1 is applied.

Here, the condition for preventing toner from returning to the sleeve is determined with respect to the potential of the image portion of the photosensitive drum. As described hereinbefore, a latent image having a density of approx. 0.2, has a potential approximately equal to the DC component (the voltage for moving to the image portion but for returning the non-image portion).

According to this embodiment, an intermediate voltage (DC component)=(½(V1+V2)) between the back transfer voltage V1 and the transfer voltage V2 for transferring the developer from the sleeve to the photosensitive drum, is selected as the high light image port,on potential of the photosensitive drum, and the time period is determined such that the toner is not returned to the sleeve under the condition that the back transfer voltage V1 is applied, as follows:

$$\frac{1}{2}aT_1^2=\frac{1}{2}\left(\frac{|q|}{m}\cdot\frac{\left|\frac{1}{2}(V_2+V_1)-V_1\right|}{d}\right)T_1^2=\frac{1}{4}|Q|\cdot\frac{|V_2-V_1|}{d}T_1^2<d \qquad \left(|Q|=\frac{|q|}{m}\right)$$

With an increase of |Q|, the influence of the electric field is increased so that reciprocation is promoted. According to this embodiment, the toner having a large Q is not returned to the developing sleeve. The maximum of Q in consideration of the transfer with the normal triboelectric distribution, is $5.0\times10^{-2}$ C/kg, and therefore, the following results as the condition for T1:

$$T_1^2<\frac{4d^2}{|Q|\cdot|V_2-V_1|} \qquad (|Q|=5.0\times10^{-2})$$

$$T_1^2<\frac{80d^2}{|V_2-V_1|} \Rightarrow T_1<\frac{8.94\times d}{\sqrt{|V_2-V_1|}}$$

In this embodiment, after the back transfer voltage and the transfer voltage are applied a plurality of times, a selective transfer voltage (the toner is transferred in the image portion, but the toner is back-transferred in the non-image portion, with the above-described DC component voltage) is applied for T3. T3 is determined as follows in this embodiment.

Under the conditions described above, when a high triboelectric charge toner is transferred to the latent image having substantially the same potential as the sleeve, it is not returned to the sleeve by the back transfer electric field. Here, the condition is selected such that the low triboelectric charge toner reaches the high light image portion from the sleeve by the developing voltage V2 and the blank voltage V3. By the transfer of the toner having a low triboelectric charge, a sufficient developing property for the high light portion can be provided. The condition therefore is expressed as follows:

$$\frac{1}{2}|Q|\frac{\frac{1}{2}|V_2-V_1|}{d}T_2^2+|Q|\frac{\frac{1}{2}|V_2-V_1|}{d}T_2\cdot T_3>d$$

$$\frac{1}{2}\frac{|Q|\cdot|V_2-V_1|}{d}T_2\left(\frac{T_2}{2}+T_3\right)>d$$

$$T_3>\frac{2d^2}{|Q|\cdot|V_3-V_1|\cdot T_2}-\frac{1}{2}T_2$$

The minimum Q in consideration of the transfer of the low triboelectric toner, is $1.5\times10^{-2}$ C/kg. By substituting it:

$$T_3>\frac{133d^2}{|V_2-V_1|\times T_2}-\frac{1}{2}T_2$$

By the application for not less than T3, the image is not influenced by T/(T+C).

In this embodiment, as described hereinbefore, after plural applications of the back transfer electric field and transfer electric field, only the DC bias is applied for T3, by which during application of the plural alternating electric field, the high triboelectric charge toner deposited on the carrier is vibrated by the electric field, so that it can be involved in the developing action. A detailed description will now be made.

As to the period T1+T2, the number of vibrations of the developer increases with an increase of the frequency, and therefore, the uniformity or smoothness of the high light portion increases. As a result of experiments, very smooth images are provided when T1+T2 is $2.5\times10^{-4}$ sec or smaller when the SD gap is 500 μm, and the potential difference V2–V1 is 2 kV.

Although the image quality is improved with a decrease of T1+T2, the density decreases. The reason is considered as follows.

As shown in FIG. 4, in one application of the high frequency wave, the high triboelectric charge toner deposited on the carrier is not sufficiently separated from the carrier, and therefore, the toner transfer described hereinbefore is not sufficient with the result of lower development performance. Therefore, as shown in FIG. 4, it is further preferable that the back transfer bias voltage V1 and the transfer bias voltage V2 are applied a plurality of times (twice in the FIG. 5 embodiment). By doing so, the high triboelectric charge toner particles are sufficiently separated from the carrier particles, and therefore, are contributable to the development.

Examples will be described.

EXAMPLE 1

The images are formed with the following developing conditions. The developing device B had the structure shown in FIG. 1, and the above-described operations were used.

Outer diameter of the developing sleeve: 32 mm

Peripheral speed of the developing sleeve: 280 mm/sec

Peripheral speed of the photosensitive drum: 160 mm/sec

S-D gap: 500 μm

The developing bias used was as shown in FIG. 4 with the use of positively chargeable toner particles. In FIG. 4,

VD=600 V, VL=50 V

V1=–550 V

V2=1450 V

V3=450 V

T1=T2=$6.25\times10^{-5}$ sec

T3=$3.75\times10^{-4}$ sec

Therefore, the following is satisfied:

$$T_1 < \frac{8.94 \times d}{\sqrt{|V_2 - V_1|}}$$

$$T_3 > \frac{133d^2}{|V_2 - V_1| \times T_1} - \frac{1}{2} T_1$$

The resultant images showed smooth high light image portions with small influence of the T/(T+C) ratio influence in the density variation.

EXAMPLE 2

The same developing conditions as in Example 1 were used except for the toner charging polarity and the bias voltage. The triboelectric charge of the toner is of the negative polarity, and the bias voltage used was as shown in FIG. 4. The bias voltages were:

VD=–600 V, VL=–50 V

V1=–50 V

V2=–1450 V

V3=–550 V

T1=T2=$5.0\times10^{-5}$ sec

T3=$4.0\times10^{-4}$ sec

Therefore, the following is satisfied:

$$T_1 < \frac{8.94 \times d}{\sqrt{|V_2 - V_1|}}$$

$$T_3 > \frac{133d^2}{|V_2 - V_1| \times T_1} - \frac{1}{2} T_1$$

The resultant images showed a high light reproducibility equivalent to or even better than Example 1 with small influence of the density variation due to T/(T+C).

EXAMPLE 3

Similarly to Example 2.

VD=–600 V, VL=–50 V

V1=–50 V

V2=–1450 V

V3=–550 V

Figure 5:
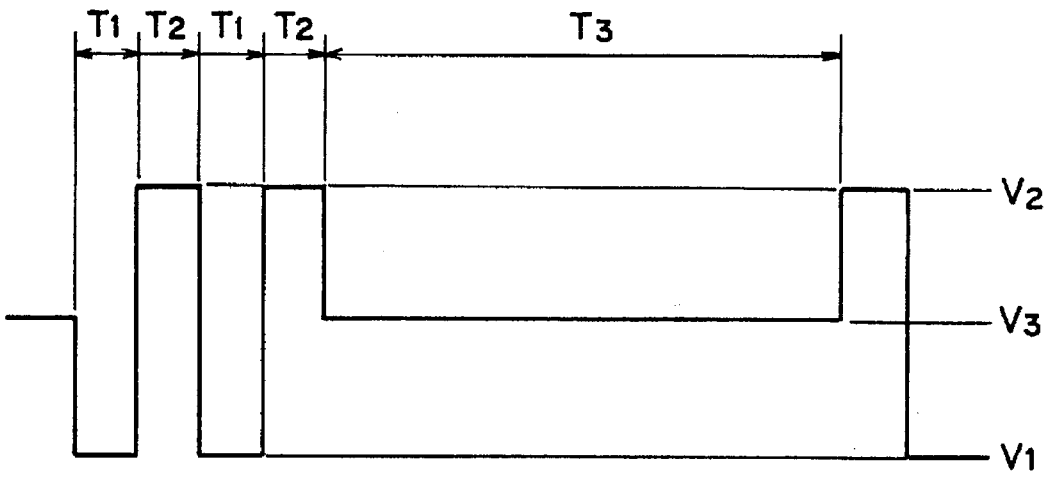
FIG. 5 is a wave form of a developing bias voltage according to an embodiment of the present invention.

The bias system was as shown in FIG. 5.

T1–T2=$4.16\times10^{-5}$ sec

T3=$4.99\times10^{-4}$ sec

Therefore, the following is satisfied:

$$T_1 < \frac{8.94 \times d}{\sqrt{|V_2 - V_1|}}$$

$$T_3 > \frac{133d^2}{|V_2 - V_1| \times T_1} - \frac{1}{2} T_1$$

The resultant images showed image quality, image density and high light reproducibility better than in the Embodiment 1 with small variation of in the density due to T/(T+C) variation.

EXAMPLE 4

Similarly to Example 2.

VD=–600 V, VL=–50 V

V1=–50 V

V2=–1450 V

V3=–550 V

Figure 6:
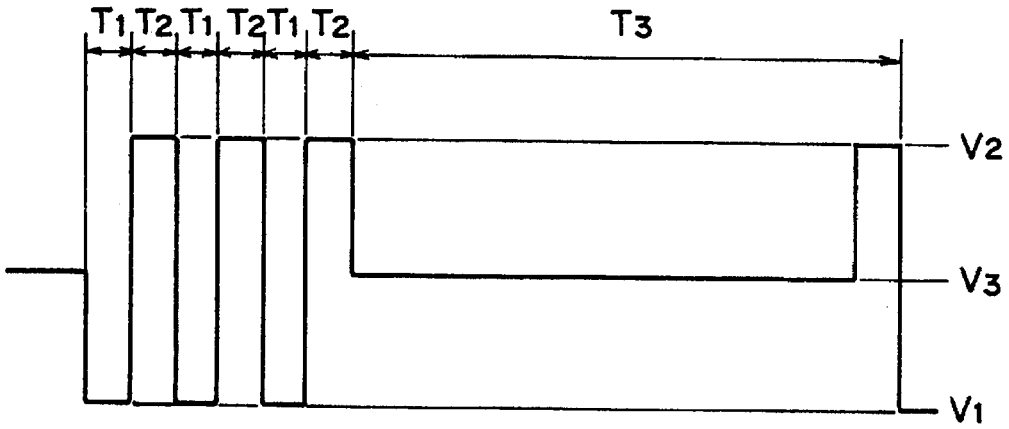
FIG. 6 is a wave form of a developing bias voltage according to an embodiment of the present invention.

The bias was as shown in FIG. 6, and:

T1=T2=$3.57\times10^{-5}$ sec

T3=$4.99\times10^{-4}$ sec

Therefore, the following is satisfied:

$$T_1 < \frac{8.94 \times d}{\sqrt{|V_2 - V_1|}}$$

$$T_3 > \frac{133d^2}{|V_2 - V_1| \times T_1} - \frac{1}{2} T_1$$

The resultant images showed an image quality, image density and an high light reproducibility equivalent to Embodiment 3 with small density variation due to the T/(T+C) variation.

Comparison Example 1

Similarly to Embodiment 2.

VD=–600 V, VL=–50 V

V1=–50 V

V2=–1450 V

V3=–550 V

The bias was as shown in FIG. 4, and:

T1=T2=6.25×10$^{-5}$ sec

T3=1.25×10$^{-4}$ sec

Therefore, the following is satisfied:

$$T_1 < \frac{8.94 \times d}{\sqrt{|V_2 - V_1|}}$$

$$T_3 < \frac{133d^2}{|V_2 - V_1| \times T_1} - \frac{1}{2} T_1$$

The resultant images showed uniform or smooth high light portions, but the variation of the image density due to the T/(T+C) variation was large, and therefore, the color nature was instable.

A description will be made as to the volume ratio which is a ratio of the volume occupied by the developer and the volume of the developing zone In which the developing action occurs in the developing device having the structure described above. The relative volume ratio is defined by the amount of the developer M (kg/m$^2$) (as the mixture and when they are not erected) per unit area of the surface of the sleeve in the developing zone, height d (m) of the developing zone, the true density ρC of the carrier particles (kg/cm$^3$), the true density of a toner particle ρT (kg/m$^3$), weight C of the carrier (kg), the toner weight T (kg), and the relative speed ratio σ between the sleeve 2 and the photosensitive member 1, as follows:

Relative volume ratio $P=M/d\times\sigma\{1/\rho C\times C/(T+C)+1/\rho T\times T/(T+C)\}\times 100$ (%)

The relative volume ratio is significantly influential in the copied image, particularly the high light portion thereof. If P is larger than 63.8, then free motion of the developer particles and particularly the toner particles in the developing zone is adversely effected with the result that the toner particles do not sufficiently vibrate. Therefore, roughness in the high light portion results even if the developing bias voltage of the present invention is used. Therefore, the uniformity of the density is not very good.

If P is smaller than 24.1, sufficient toner is not supplied in the developing step with the result of reduction of the image density or heavy roughness caused by the contact of the magnetic brush without the toner to the drum, although it is dependent on the T/(T+C) ratio, which will be described hereinafter. If T/(T+C) is larger than 0.1, then toner scattering occurs because of the specific surface area relative to the carrier when small size toner particles are used.

If T/(T+C) is smaller than 0.04, then sufficient toner is not supplied in the developing step as in the case when the relative volume ratio P is lower than 24.1, and therefore, the image density will be decreased, and heavy roughness occurs.

Therefore, sufficient high density quality images can be provided with stability by using the above-described developing baas voltage, by satisfying the relative volume ratio P which is not less than 24.1 and not more than 63.8, and by satisfying T/(T+C) not less than 0.04 and not more than 0.1.

Further examples will be described.

EXAMPLE 5

The images were formed with the following developing conditions. The developing device B was as shown in FIG. 1, and the above-described operations were used:

Peripheral speed of the developing sleeve: 2.8×10$^{-1}$ m/sec

Peripheral speed of the photosensitive drum: 1.6×10$^{-1}$ m/sec

Relative speed ratio σ=1.75 S/D gap d=5.0×10$^{-4}$ m

True density of a toner particle ρT=1.0×10$^3$ kg/m$^3$

True density of a carrier particle ρC=5.0×10$^3$ kg/m$^3$

Amount of developer application M–5.0×10$^{'1}$ kg/m$^2$

T/(T+C) ratio: 0.05

Therefore, the relative volume ratio P=42.0 which is between 24.1 and 63.8, and the T/(T+C) ratio is 0.05 which is between 0.04 and 0.1.

The developing bias was as shown in FIG. 4.

The toner charging polarity was negative. In FIG. 4, the following values were used:

VD=–600 V, VL=–50 V

V1=+550 V, V2=–1450 V, V3=–450 V

T1=5.0×10$^{-5}$ sec

T2=5.0×10$^{-5}$ sec

T3=4.0×10$^{-4}$ sec

Therefore the following is satisfied:

$$T_1 < \frac{8.94 \times d}{\sqrt{|V_2 - V_1|}}$$

$$T_3 < \frac{133d^2}{|V_2 - V_1| \times T_2} - \frac{1}{2} T_2$$

The resultant images showed good high light reproducibility, and the maximum image density was sufficient with small variation of the image density due to T/(T+C) variation.

EXAMPLE 6

The following developing conditions were used.

Peripheral speed of the developing sleeve: 2.4×10$^{-1}$ m/sec

Peripheral speed of the photosensitive drum: 1.3×10$^{-1}$ m/sec

Relative speed ratio σ=1.85 S/D gap d=6.0×10$^{-4}$ m

True density of a toner particle ρT=1.0×10$^3$ kg/m$^3$

True density of a carrier particle PC=5.0×10$^3$ kg/m$^3$

Amount of developer application M=6.0×10$^{-1}$ kg/m$^2$

T/(T+C) ratio: 0.07

The relative volume ratio P is 47.7 which is between 24.1 and 63.8, and the T/(T+C) ratio is 0.07 which is between 0.04 and 0.1.

The developing bias voltage used was as shown in FIG. 5. The toner charging polarity was negative, and in FIG. 5,

VD=–600 V, VL=31 50 V

V1=+550 V, V2=–1450 V, V3=–450 V

T1=4.16×10$^{-5}$ sec

T2=4.16×10$^{-5}$ sec

T3=4.99×10$^{-4}$ sec

Therefore, the following was satisfied:

$$T_1 < \frac{8.94 \times d}{\sqrt{|V_2 - V_1|}}$$

$$T_3 < \frac{133d^2}{|V_2 - V_1| \times T_2} - \frac{1}{2} T_2$$

The resultant images showed a high light reproducibility which is equivalent or even better than in Embodiment 1 with sufficient maximum image density with small variation in the density due to T/(T+C) ratio variation.

EXAMPLE 7

In this embodiment, the following developing conditions were used:

Peripheral speed of the developing sleeve: $2.9\times10^{-1}$ m/sec

Peripheral speed of the photosensitive drum: $2.0\times10^{-1}$ m/sec

Relative speed ratio a σ1.45 S/D gap $d=4.0\times10^{-4}$ m

True density of a toner particle $\rho T=1.0\times10^{3}$ kg/m$^3$

True density of a carrier particle $\rho C=5.0\times10^{3}$ kg/m$^3$

Amount of developer application $M=4.0\times10^{-1}$ kg/m$^2$

T/(T+C) ratio: 0.08

The relative volume ratio P=38.3 which is between 24.1 and 63.8, and the T/(T+C) ratio is 0.08 which is between 0.04 and 0.1.

The developing bias used was as shown in FIG. 6. The toner charging polarity was negative. In FIG. 6,

VD=−600 V, VL=−50 V

V1=+550 V, V2=−1450 V, V3=−450 V $T1=3.57\times10^{-5}$ sec $T2=3.57\times10^{-5}$ sec $T3=4.99\times10^{-4}$ sec Therefore, the following is satisfied:

$$T_1 < \frac{8.94 \times d}{\sqrt{|V_2 - V_1|}}$$

$$T_3 < \frac{133d^2}{|V_2 - V_1| \times T_2} - \frac{1}{2} T_2$$

The resulting image showed a high light reproducibility equivalent to Embodiment 2, and a sufficiently stability maximum density and with small density variation due to T/(T+C) variation with.

In the foregoing embodiments 1, 2, and 3, the bias voltage application periods T1 and T2 are the same, but this is not limiting, and the present invention is applicable to the case where T1 and T2 are different from each other.

Embodiment 8

The following developing conditions were used:

Peripheral speed of the developing sleeve: $2.8\times10^{-1}$ m/sec

Peripheral speed of the photosensitive drum: $1.6\times10^{-1}$ m/sec

Relative speed ratio ρ=1.75 S/D gap $d=5.0\times10^{-4}$ m

True density of a toner particle $\rho T=1.0\times10^{3}$ kg/m$^3$

True density of a carrier particle $\rho C=5.0\times10^{3}$ kg/m$^3$

Amount of developer application $M=5.0\times10^{-1}$ kg/m$^2$

T/(T+C) ratio: 0.05

Therefore, similarly to the foregoing embodiments, the relative volume ratio P=42.0 which is between 24.1 and 63.8, and T/(T+C) ratio is 0.05 which is between 0.04 and 0.1.

The developing bias voltage was as shown in FIG. 4, and the toner charge polarity was negative. In FIG. 4,

VD=−600 V, VL=−50 V

V1=+550 V, V2=−1450 V, V3=−450 V $T1=6.25\times10^{-5}$ sec $T2=6.25\times10^{-5}$ sec $T3=1.25\times10^{-4}$ sec Therefore, the following is satisfied:

$$T_1 < \frac{8.94 \times d}{\sqrt{|V_2 - V_1|}}$$

$$T_3 < \frac{133d^2}{|V_2 - V_1| \times T_2} - \frac{1}{2} T_2$$

The resultant images showed good high light reproducibility and the maximum image density was sufficient. However, as compared with Examples 1–3, the density variation due to T/(T+C) ratio variation was large as compared with the foregoing embodiments, and the color nature was instable.

Comparison Example 2

The developing conditions were as follows:

Peripheral speed of the developing sleeve: $2.4\times10^{-1}$ m/sec

Peripheral speed of the photosensitive drum: $1.6\times10^{-1}$ m/sec

Relative speed ratio σ=1.5 S/D gap $d=6.5\times10^{-4}$ m

True density of a toner particle $\rho T=1.0\times10^{3}$ kg/m$^3$

True density of a carrier particle ρC–$5.0\times10^{3}$ kg/m$^3$

Amount of developer application $M=3.5\times10^{-1}$ kg/m$^2$

T/(T+C) ratio: 0.04

As contrasted to the foregoing examples, the relative volume ratio P was 18.7 which is outside the range between the 24.1 and 63.8, although the T/(T+C) ratio is 0.04 which is in the range between 0.04 and 0.1.

The developing bias was as shown in FIG. 4, and the toner charging polarity was negative. In FIG. 4,

VD=−600 V, VL=−50 V

V1=+550 V, V2=−1450 V, V3=−450 V $T1=5.0\times10^{-5}$ sec $T2=5.0\times10^{-5}$ sec $T3=4.0\times10^{-4}$ sec Therefore, the following is satisfied:

$$T_1 < \frac{8.94 \times d}{\sqrt{|V_2 - V_1|}}$$

$$T_3 < \frac{133d^2}{|V_2 - V_1| \times T_2} - \frac{1}{2} T_2$$

The resultant images were insufficient in high light reproducibility and maximum image density.

While the invention has been described with reference to the structures disclosed herein, it is not confined to the details set forth. This application is intended to cover such modifications or changes as may come within the purposes of the improvements or the scope of the following claims.

What is claimed is:

1. An image forming apparatus comprising:

an image bearing member for bearing an electrostatic image;

a developer carrying member, opposed to said image bearing member, for carrying a developer containing toner;

bias voltage applying means for applying a developing bias voltage to said developer carrying member, said bias voltage satisfying:

$$T1 < 8.94d/\sqrt{|V2 - V1|},$$

$$T3 > (133d^2/T2|V2 - V1|) - 1/2T2$$

V1 (V): a voltage applying force to the toner toward said developer carrying member away from said image bearing member;

T1 (sec): a time period of application of the voltage V1;

V2 (V): a voltage applying force to the toner away from said developer carrying member toward said image bearing member;

T2 (sec): a time period of application of the voltage V2;

T3 (sec): a time period of application of a voltage V3 which is (V1+V2)/2;

d (m): distance between said image bearing member and said developer carrying member.

2. An apparatus according to claim 1, wherein the voltage V3 is applied after oscillation between the voltages V1 and V2.

3. An apparatus according to claim 2, wherein the oscillation between the voltages V1 and V2 occurs a plurality of times.

4. An apparatus according to claim 1, wherein |VD|>|V3|>|VL| is satisfied where VL is a potential of an image portion on said image bearing member, and VD is a potential in a non-image portion on said image bearing member.

5. An apparatus according to claim 1, wherein the developer is a two component developer containing toner particles and carrier particles.

6. An apparatus according to claim 5, wherein a weight ratio T/(T+C) is not less than 0.04 and not more than 0.1, where T is a toner particle content and C is a carrier particle content.

7. An apparatus according to claim 1, wherein a relative volume ratio P (%) of the developer in a developing zone satisfies $24.1 \leqq P \leqq 63.8$.

8. An apparatus according to claim 1, wherein time periods T1 and T2 are equal.

9. An apparatus according to claim 1, further comprising beam emitting means for emitting toward said image bearing member a light beam modulated in accordance with an image signal, and control means for controlling a light beam emitting period per one pixel in accordance with an image density.

* * * * *

UNITED STATES PATENT AND TRADEMARK OFFICE

CERTIFICATE OF CORRECTION

PATENT NO. : 5,669,050

DATED : Sept. 16, 1997

INVENTOR(S) : SAKEMI ET AL.

It is certified that error appears in the above-identified patent and that said Letters Patent is hereby corrected as shown below:

Column 1

Line 17, "hearing" should read --bearing--; and
Lines 29, "developer" should read --developers--.

Column 2

Line 9, "this" should read --this manner--;
Line 31, "contrast" should read --contrast V0--; and
Line 50, "vibrates" should read --vibrate--.

Column 5

Line 12, "a" should read --an--;
Line 34, "1" should read --6-- and "6" should read --1--; and
Line 43, "Therafter image" should read --Thereafter, an image--.

Column 6

Line 12, "carries" should read --carrier--.

UNITED STATES PATENT AND TRADEMARK OFFICE

CERTIFICATE OF CORRECTION

PATENT NO. : 5,669,050

DATED : Sept. 16, 1997

INVENTOR(S) : SAKEMI ET AL.

It is certified that error appears in the above-identified patent and that said Letters Patent is hereby corrected as shown below:

Column 7

Line 14, "delete "uniformly"; and
Line 15, "are" should read --are uniformly--; and
Line 43, "a" (second occurrence) should be italicized;
Line 43, "$\delta V$" should read --$\Delta V$--; and
Line 63, 'port,on" should read --portion--.

Column 8

Line 50, "$V_3$" should read --$V_2$--.

Column 9

Line 54, "influence" (second occurrence) should be deleted.

Column 10

Line 35, delete "in"; and
Line 57, delete "an".

UNITED STATES PATENT AND TRADEMARK OFFICE

CERTIFICATE OF CORRECTION

PATENT NO. : 5,669,050

DATED : Sept. 16, 1997

INVENTOR(S) : SAKEMI ET AL.

It is certified that error appears in the above-identified patent and that said Letters Patent is hereby corrected as shown below:

Column 11

Line 18, "In" should read --in--;
Line 36, "effected" should read --affected--; and
Line 56, "baas" should read --bias--.

Column 12

Line 42, "PC" should read --ρC--; and
Line 51, "VL=31 50 V" should read -- VL = 50V--.

Column 13

Line 10, "ratio a σ1.45" should read --ratio σ = 1.45--;
Line 36, "stability" should read --stable--;
Line 37, delete "and"; and
Line 38, delete "with".

Signed and Sealed this

Twenty-eighth Day of April, 1998

Bruce Lehman

*Attest:*

BRUCE LEHMAN

*Commissioner of Patents and Trademarks*

*Attesting Officer*